US005839405A

United States Patent [19]

Falkowski et al.

[11] Patent Number: 5,839,405

[45] Date of Patent: Nov. 24, 1998

[54] SINGLE/MULTI-CHAMBER PERFORATED TUBE RESONATOR FOR ENGINE INDUCTION SYSTEM

[75] Inventors: Alan Falkowski, Lake Orion; Piotr Czapski, Farmington Hills; Dennis A. Soltis, Goodrich, all of Mich.

[73] Assignee: Chrysler Corporation, Auburn Hills, Mich.

[21] Appl. No.: 883,774

[22] Filed: Jun. 27, 1997

[51] Int. Cl.[6] ..... F02M 35/10

[52] U.S. Cl. ..... 123/184.57

[58] Field of Search ..... 123/184.53, 184.57, 123/184.21

[56] References Cited

U.S. PATENT DOCUMENTS

| | | | |
|---|---|---|---|
| 3,990,414 | 11/1976 | Malphettes . | |
| 4,538,556 | 9/1985 | Takeda . | |
| 5,107,800 | 4/1992 | Araki et al. . | |
| 5,161,492 | 11/1992 | Hitomi et al. | 123/184.57 |
| 5,333,576 | 8/1994 | Verkleeren . | |
| 5,595,150 | 1/1997 | Horlacher | 123/184.57 |

FOREIGN PATENT DOCUMENTS

| | | | |
|---|---|---|---|
| 1-253560 | 10/1989 | Japan | 123/184.57 |

*Primary Examiner*—David A. Okonsky
*Attorney, Agent, or Firm*—Kenneth H. MacLean

[57] ABSTRACT

An engine induction system resonator that is designed to minimize emitted engine noise. The resonator includes an enclosed tube that has a first diameter and that defines a resonant chamber therein. The resonator also includes a pipe that has a second diameter smaller than the tube diameter. The pipe extends axially through the tube and has first and second ends that connect to other induction system components to channel inductive air flow therethrough. The pipe defines a plurality of perforated holes distributed along a section of the pipe housed within the tube. The plurality of perforated holes is distributed along the pipe in a manner that minimizes emitted engine noise. The resonator is designed in view of other system components to minimize overall system cost and overall required system implementation area.

12 Claims, 10 Drawing Sheets

SINGLE/MULTI-CHAMBER PERFORATED TUBE RESONATOR FOR ENGINE INDUCTION SYSTEM

BACKGROUND OF THE INVENTION

1. Technical Field

The present invention relates generally to motor vehicle induction systems, and more particularly to a motor vehicle induction system resonator that minimizes the amount of engine noise emitted by that system.

2. Discussion

It is desirable to design an engine induction system such that engine noise emitted by the system is minimized. Conventionally, emitted system noise is minimized through implementation of an objective, or cost, function defined by several objective parameters. Typically, total sound pressure level (SPL), often referred to as dB(A) noise level, is engine noise emitted by the engine through the induction system weighted by human ear perception characteristics, and is the most commonly used objective parameter. Unweighted SPL can alternatively be utilized in place of weighted SPL. Another objective parameter that may be utilized is total loudness as defined by International Standards Organization (ISO) R 532b recommendation. Further, induction system dimensions may also be utilized in the objective function, as well as system component volumes and/or lengths. The function as defined by these parameters can thus be used to minimize noise levels associated with the system. The function may also be used to minimize system dimensional requirements, and thus production costs and space requirements for a modeled system.

Conventionally, the objective function has been implemented through trial and error adjustment of the above mentioned parameters. Overall system optimization is difficult to achieve, however, as adjustment of each of the numerous parameters in the function affects the weighting factor associated with the other function parameters.

Software engine and induction system modeling programs exist that allow an engine and induction system to be modeled as a noise source. Software programs also exist that allow induction system part sizes and locations to be modeled. However, no methods exist that allow objective parameters such as those mentioned above to be weighted according to specified design criteria to allow different systems to be designed for different engines. Also, numerous trial and error iterations must be run to generate a system model. Each iteration could lead to degradation in system design rather than an improvement, due to the acoustic coupling between the system parameters and inherent subjectiveness involved in changing system parameters in the existing programs.

The system resonator is an integral component in most engine induction systems, as resonator design is crucial to noise minimization. While induction system resonators are conventional components, there is a need for an induction system resonator that is designed with other system component parameters being taken into consideration to provide optimized noise suppression.

SUMMARY OF THE INVENTION

Accordingly, the present invention provides a concentric tube perforated resonator that reduces the noise emitted from a motor vehicle engine induction system. The resonator also optimizes the acoustical characteristics of the engine so as to emit acoustically pleasing engine harmonic frequencies. The resonator of the present invention is designed to have optimal dimensions to minimize resonator costs and implementation area required.

More particularly, the present invention provides an engine induction system resonator that includes an enclosed tube having a first diameter and that defines a resonant chamber therein. A pipe having a second diameter smaller than the first diameter of the tube extends axially through the tube. The pipe includes first and second ends that connect to other induction system components. The pipe channels inductive air flow therethrough, and defines a plurality of perforated holes distributed along a section of the pipe housed within the tube. The plurality of perforated holes distributed along the pipe in a manner that minimizes emitted engine noise. In addition, the enclosed tube may be positioned to form two or more resonant chambers, according to specific application parameters.

DETAILED DESCRIPTION OF THE PREFERRED EMBODIMENT

Figure 1:
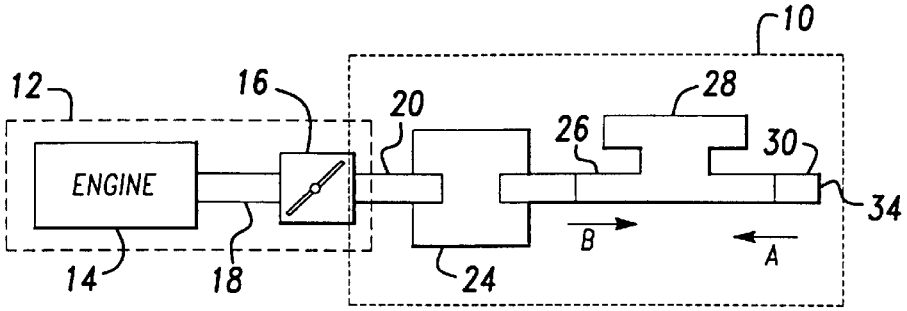
FIG. 1 is a schematic block diagram of an induction system modeled by the optimization logic of the present invention.
Figure 2A:
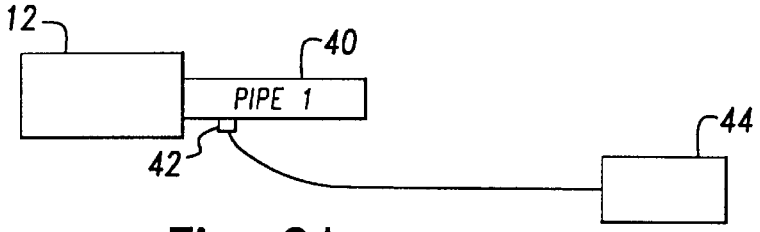
FIGS. 2A–2D are schematic block diagrams illustrating the generation of data relating to motor vehicle engine impedance for use by the implementation logic of the present invention.
Figure 2B:
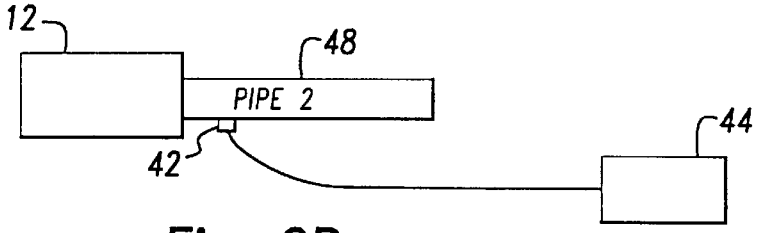
Figure 2C:
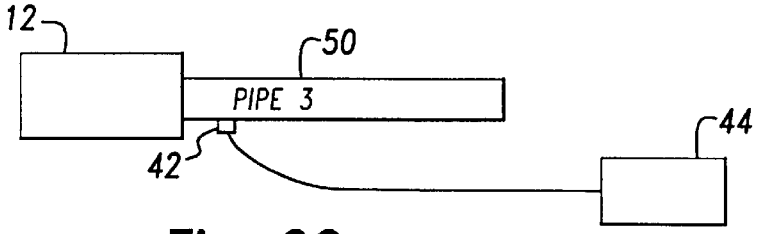
Figure 2D:
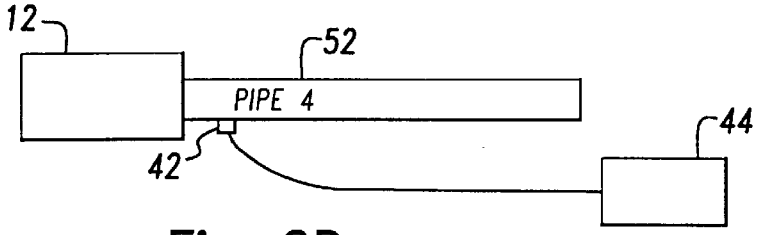

Referring to the drawings, FIG. 1 illustrates an air induction system 10 that is designed according to the system design methodology of the present invention. The air induction system 10 is operatively coupled to a noise source 12, which consists of a conventional motor vehicle engine 14 having an associated engine throttle 16 and a fresh air intake manifold 18, all of which are of the type well known in the art. A hose 20 is connected to the throttle body and couples the acoustic source 12 to the air induction system 10.

The air induction system 10 includes a first component 24, which is preferably an air filter to filter dirt and other particles from the air before the air enters the manifold 18. Alternatively, the component may be a resonator for reducing noise associated with resonant frequencies produced by the engine system 12. The component 24 is next coupled via hose 26 to a resonator 28, which is preferably a Helmholtz resonator used to minimize the noise being emitted by the acoustic source. The Helmholtz resonator 28 in turn is coupled by a hose 30 to an air inlet 34 through which air enters the induction system and is input into the engine system 12. Therefore, while fresh air flows from right to left through the air induction system 10 as indicated by Arrow A, engine noise is emitted from the engine system 12 in the direction as indicated by arrow B.

FIG. 2 illustrates one process of generating a first submodel of the engine 14 and intake manifold 18 as an acoustic source, as characterization of the engine source impedance is required by the methodology of the present invention. The induction system is connected to the engine system 12 preferably at the throttle body 18. Initially, a straight pipe 40 of a first predetermined length is connected directly to the throttle body 18. The engine is then run at a first RPM setting, and SPL and particle velocity associated with the sound wave being emitted from the acoustic source (hereinafter referred to as velocity) is measured by a sensors 42, which are preferably of an instrument grade quality, in the crank angle domain. Pressure and velocity data are transmitted from the sensors 42 to a data recorder, or controller, 44 that includes a processor and an associated memory.

The collected data is then converted to the frequency domain through a Fast Fourier Transform (FFT) method. Engine frequencies of interest are at or below 1500 hertz, as the associated frequencies correspond to the bandwidth of interest for intake noise. The DC component of these signals is removed, as, for test purposes, only fluctuations about the mean flow conditions are of interest. The data is preferably stored in the controller memory for subsequent retrieval and use by the methodology of the present invention.

After the inducted air pressure and velocity are measured in conjunction with the first pipe 40, first pipe 40 is removed, and a second pipe 48 having a second predetermined length is attached to the throttle body. Pressure and velocity measurements are taken in conjunction with the second pipe 48 and are stored in the controller 44. Similar measurements are then taken for pipes 50, 52 having third and fourth predetermined lengths. The resulting generated data is stored in the controller 44 for subsequent use by the methodology of the present invention as will now be described.

It should be appreciated at this point that an alternative method of calculating induction system air pressure and velocity may be realized through the use of commercially available software packages such as Ricardo's Wave Engine Simulation, which simulate thermodynamic processes associated with internal combustion engines. Simulated induction system air pressure and velocity may be determined through such process simulation, and the simulated data can then be used in place of, or in accompaniment with, measured data.

Typically, acoustical impedance is generated from induction system air pressure and velocity. Similarly, the mach number of the inductive air flow, which is derived from the mean value of the inducted air flow velocity divided by the speed of sound, is also calculated. These generated values are then stored in the controller and used as inputs to the induction system modeling methodology of the present invention.

Figure 3:
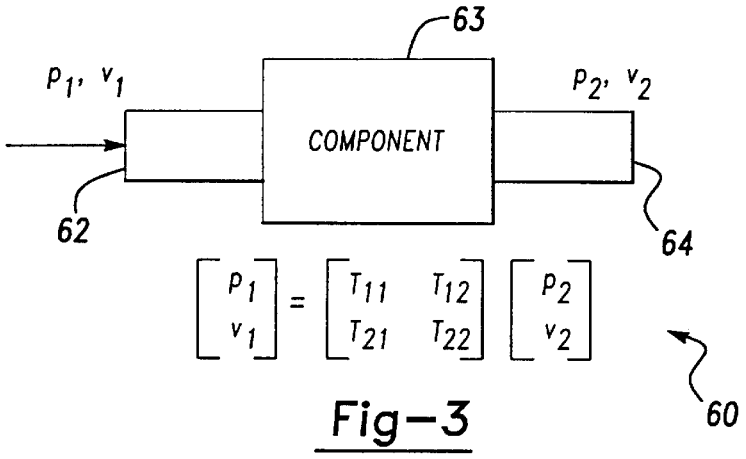
FIG. 3 illustrates a system component used in the system model of the present invention and the associated transmission matrix.

Referring now to FIG. 3, a transmission matrix shown at 60 is used in a second submodel of the present invention to model intake system components.

The transmission matrix submodel relates induction system inlet air pressure and velocity $P_1$, $V_1$ at an inlet 62 of an induction system component 63, to the pressure and velocity $P_2$, $V_2$ at a component outlet 64. Transmission matrix coefficients $T_{11}$, $T_{12}$, $T_{21}$, $T_{22}$ are determined by the geometrical dimensions of the component. The induction system component submodel assumes no temperature gradients in the system and does not take non-linear effects into consideration. Preferably, the transmission matrix coefficients for most commonly used induction system components are programmed into the submodel, as most of these coefficients have been derived analytically from published sources. However, when a perforated concentric tube resonator component, such as that which is the subject of the present invention is utilized, no closed end analytical solution exists, and the transmission matrix for such an element must be calculated numerically.

Figure 4:
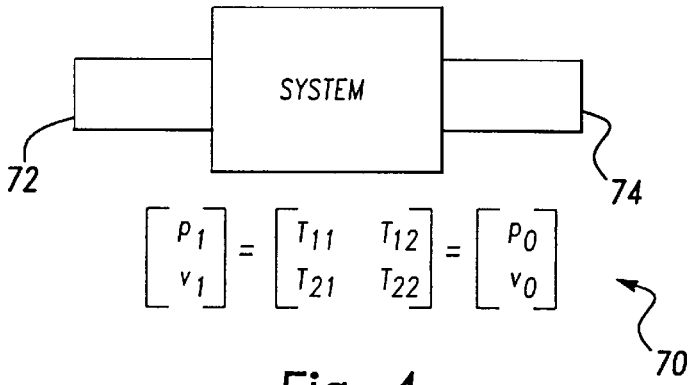
FIG. 4 illustrates a diagram of an induction system modeled by the optimization logic of the present invention and the associated transmission matrix.

FIG. 4 illustrates at 70 an overall transmission matrix for the induction system extending from the throttle body 16 to the air inlet 34. The matrix is generated by multiplying the transmission matrices of all components to be utilized in the system to produce transmission coefficients $T_{11}$, $T_{12}$, $T_{21}$, $T_{22}$. The overall transmission matrix relates pressure and velocity, $P_I$, $V_I$, shown at 72, at the throttle body to pressure and velocity $P_O$, $V_O$, shown at 74, at the fresh air inlet. The matrix 70 is then utilized to determine overall component dimensions and locations, as will be described below.

Figure 5:
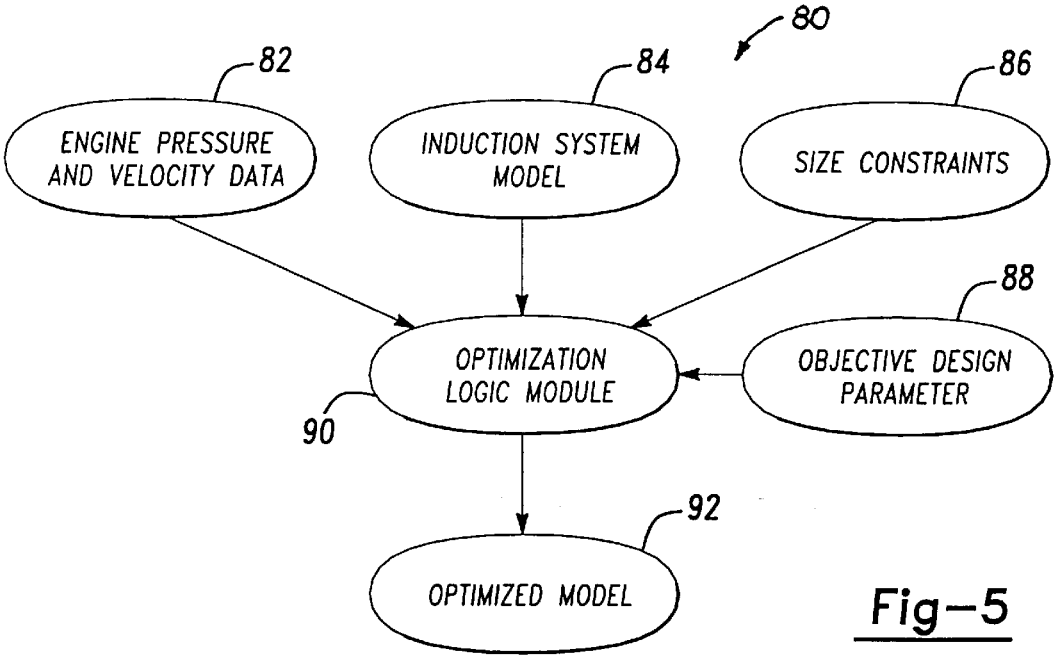
FIG. 5 is an entity relationship diagram illustrating the process of utilizing submodels created from input design parameters of the present invention to optimize induction system design.

Referring to FIG. 5, an entity relationship diagram illustrating the three submodels utilized by the induction system optimization logic of the present invention is shown generally at 80. Engine pressure and velocity data from the engine submodel 82, along with parameters from the induction system submodel 84, and implementation area size constraints comprising a third system submodel 86, are the three sets of variables that are input into the optimization logic 90 of the present invention. The optimization logic 90 is preferably a genetic optimization program, such as the type publicly available from the National Space and Aeronautics Administration, implemented in conventional C programming language. The logic mutates and combines the numerous possible configurations given the input parameters from the submodels 82, 84, 86 and the objective parameter 88 until an optimal system model 92 is generated. The logic therefore allows a solution to be achieved by interrelating the numerous parameters from all of the above submodels, given a specified objective parameter. Conventional optimization methods typically utilize input parameters only from individual submodels such as those described above, and do not permit interrelation of parameters such as dimensional constraints, part sizes, and engine noise source characteristics.

It should be appreciated that the objective parameter 88 to be minimized is total sound pressure level (SPL) weighted by human ear characteristics. However, this parameter may also be input as unweighted SPL, or, alternatively, total loudness as defined by ISO R 532b recommendation. Sound quality metrics are other objective parameters that may be introduced such that the noise emitted includes acoustically pleasing resonant harmonics. A single value for any of these objective parameters is obtained by adding each respective contribution from a number of engine speeds and frequencies. This objective parameter is input along with other induction model parameters, including data relating to existing induction system component volumes and/or lengths. Each of these parameters may be weighted to emphasize particular engine operating speeds, such as those speeds, or the range of speeds, correlating to engine acceleration characteristics and gear shift points. In addition, SPL may be input with respect to noise levels outside of the vehicle, as well as inside of the vehicle. Those levels inside the vehicle may be calculated from outside noise levels using a vehicle transfer function, as is well known in the art.

In addition, referring to the design size constraints 86, any number of constraints on system size and geometry can be specified. Each dimension of every element in the induction system can be constrained to be within certain limits. Moreover, linear constraint functions can be added to the methodology of the present invention, such as to the matrix 70, to assure that entire components or component combinations fit within the space available. These constraints are a critical part of system optimization since the constraints assure that an optimal design can be realized.

Minimum and maximum values for each input parameter are implemented by limiting the search space of the optimization methodology of the present invention. These linear constraints are then enforced through use of penalty functions programmed into the methodology.

Figure 6:
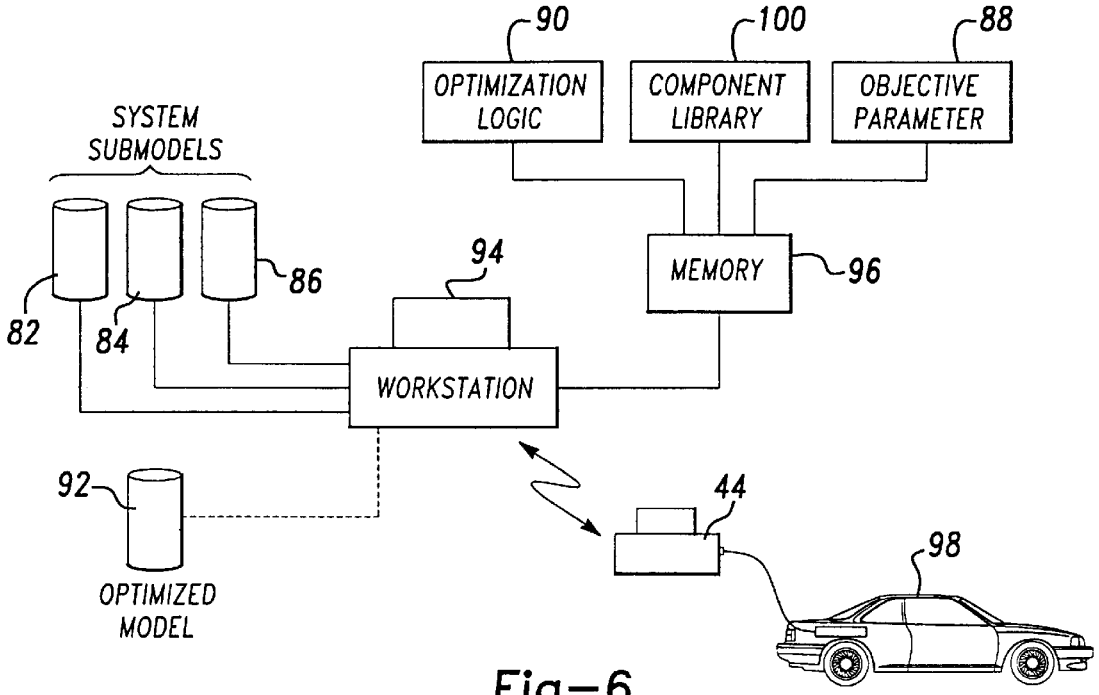
FIG. 6 is a schematic block diagram illustrating the system utilized to implement the optimization logic of the present invention.

FIG. 6 illustrates a system for generating an optimized induction system model. The system includes a computer 94, such as an SGI workstation, that includes a memory 96, such as a random access memory (RAM), read only memory (ROM) or any other type of conventional computer memory. Engine pressure and velocity data is collected from the engine and intake manifold 12 (FIGS. 2A–2D) located in a motor vehicle, such as the motor vehicle 98. The collected data is then downloaded from the computer 44 to the memory 96 for use in generating the first submodel 82. The memory 96 also includes a library of components 100 for selection and use in generating the second submodel 84, as well as the input objective parameter 88 that is to be minimized by the optimization logic software module 90. Dimensional constraints are entered into the third submodel 86 through the workstation in a conventional data entry manner.

Once all data is entered into the submodels 82, 84, 86, and the memory 96, the workstation runs the optimization logic software module 90 of the present invention to generate the optimized induction system model 92. Typical run times for such a workstation are between two and twelve hours, depending upon specific parameters used and the system being modeled.

Optimal induction system dimensions are found through global optimization of the objective parameter through use of the optimization logic of the present invention. The logic has been shown to converge to the same global solution when initialized with several different initial model conditions. In addition to the optimized solution generated by the methodology of the present invention, generated close to optimized solutions can also be saved from a single optimization run for comparison of various designs in a post-processing stage. Non-optimized solutions can in some cases be preferable due to factors not included in the objective function, such as subjective sound quality or ease of manufacturing.

Figure 7:
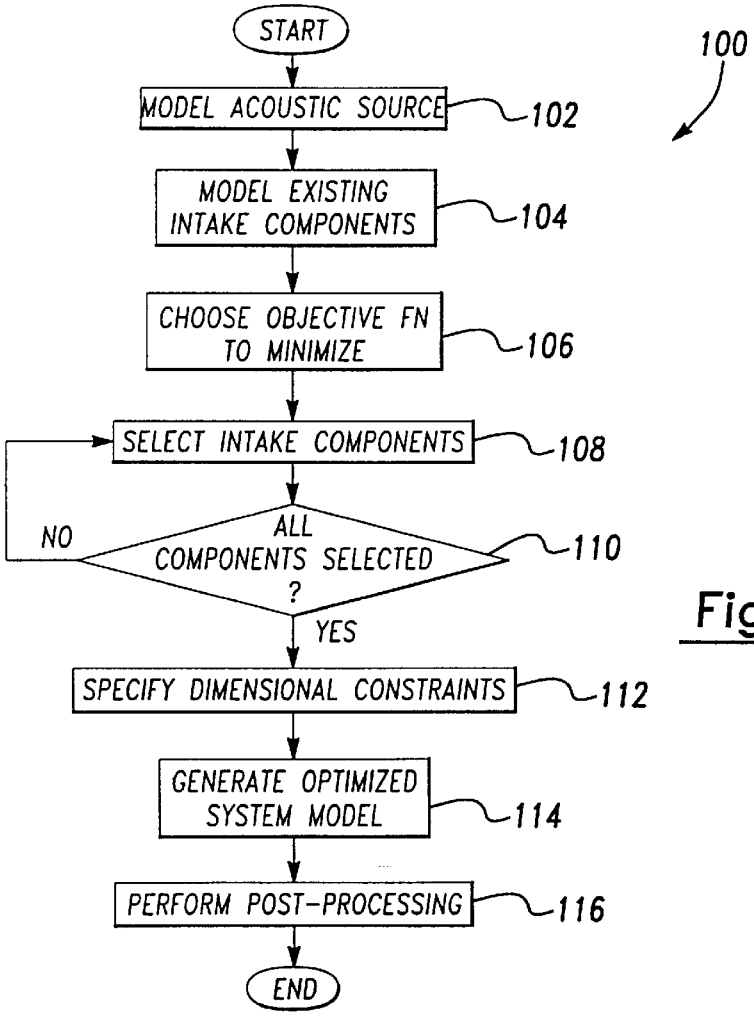
FIG. 7 is a flow diagram illustrating the optimization logic of the present invention.

Referring to FIG. 7, a flow diagram illustrating the steps used to implement the methodology of the present invention is shown generally at 100. At step 102, engine noise and pressure data is input into the first submodel. At step 104, data on existing induction system components, including the air cleaner, inlet pipe and connecting hoses is input into the second submodel. At step 106, the objective function to be optimized is input into the memory 94. At step 108, the intake system elements to be utilized are chosen from the induction system elements library 92 and input into the second submodel. At step 110, the logic determines if all intake components to be used in the system model have been entered. If not, the logic returns to step 108, and further components are selected. If all components have been selected, at step 112, system dimensional constrains and the size of the intake system elements chosen at step 108 are input into the third submodel. At step 114, the optimization logic software block optimizes the intake system design to minimize the objective function input at step 106, given the elements chosen at step 108 and the constraints input at step 112. Subsequently, at step 116, the methodology processes the data output at step 114 for evaluation purposes.

It should be appreciated that at step 116, a number of post-processing options are available. Graphs of total SPL versus RPM in db and db(A) may be generated and used for comparison of different designs and the baseline system. Also, frequency plots of sound levels at each RPM may be created. Loudness plots versus RPM can also be generated. Total volume and length of the induction system may also be calculated. To compare psychoacoustic noise characteristics, digital sound files may also be created and saved. In addition, subjective evaluation of the engine induction noise is then possible through listening to the outputs of different generated designs.

In the preferred embodiment of the present invention, software has been used to design engine induction systems for Chrysler 2.4 liter, 3.5 liter and 2.0 liter engines. Prototypes of the resulting optimized design systems were built, and noise levels recorded in a dynamometer test room. Improvements of as much as 10 db(A) over baseline production system were achieved. Significant frequency content refinements of the noise spectra were also obtained. Subjective evaluation of the recorded data also showed significant improvements in the model designs.

It is contemplated that the methodology of the present invention may be used to design optimized engine induction systems that fit in existing production engine compartment enclosures, thereby minimizing changes necessary to introduce the new, improved systems. For example, for the Chrysler 2.4 liter engine, total induction system volume was decreased from an old production system volume of 10 liters to 6 liters. The number of parts was also decreased through elimination of one resonator.

Figure 8A:
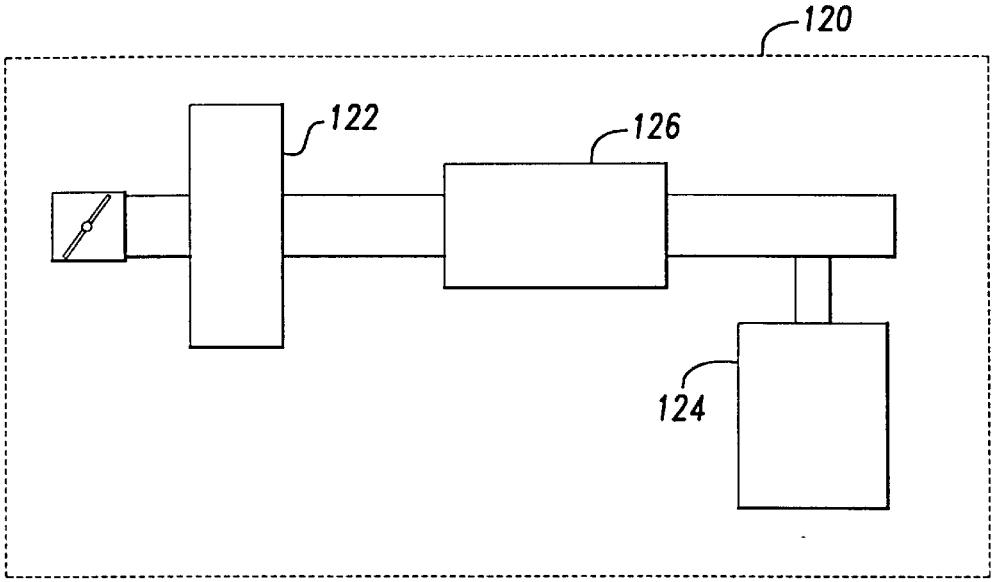
FIGS. 8A and 8B illustrate parameters input into the system of FIG. 6, and the resulting optimized induction system, respectively.
Figure 8B:
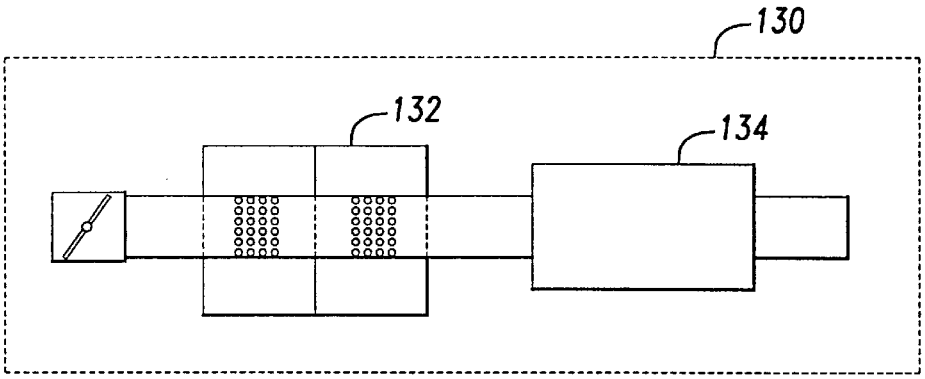

FIG. 8A illustrates an exemplary induction system prior to optimization of the present invention generally at 120. The system includes two resonators 122, 124 and an air cleaner 126. The parameters are associated with a 2.4 liter Chrysler engine. Subsequent to the parameters being processed, the system optimization logic results in an optimized induction system as shown at 130 in FIG. 8B. The system requires only one multi-chamber resonator 132 and an air filter 134.

Figure 9:
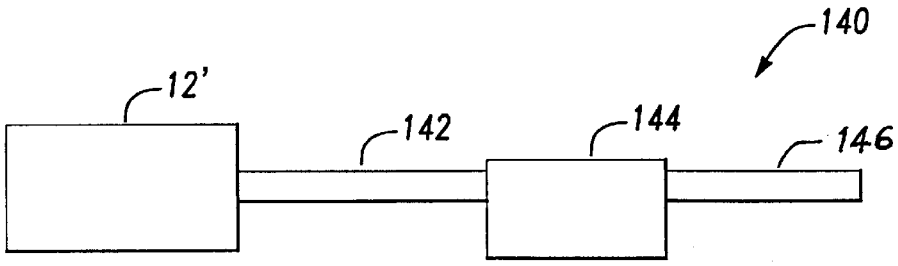
FIG. 9 is a schematic block diagram of an exhaust system modeled by the optimization logic of the present invention.

FIG. 9 illustrates an exhaust system 140 modeled using the optimization logic of the present invention. The exhaust system includes an acoustic noise source 12', an exhaust pipe 142 connected to the acoustic noise source, a muffler 144 connected to the exhaust pipe and an exhaust pipe 146 exiting to the atmosphere. Each of the aforementioned components is of a make and model as selected by the system designer. System parameters, including engine pressure and exhausted air velocity data and implementation area size constraints, are entered along with chosen component parameters, corresponding generally to the optimization logic shown and described above for the induction system 10. The logic of the present invention utilizes this data and generates an exhaust system model that minimizes a selected objective parameter, such as emitted engine source noise, given the input parameters.

Figure 10:
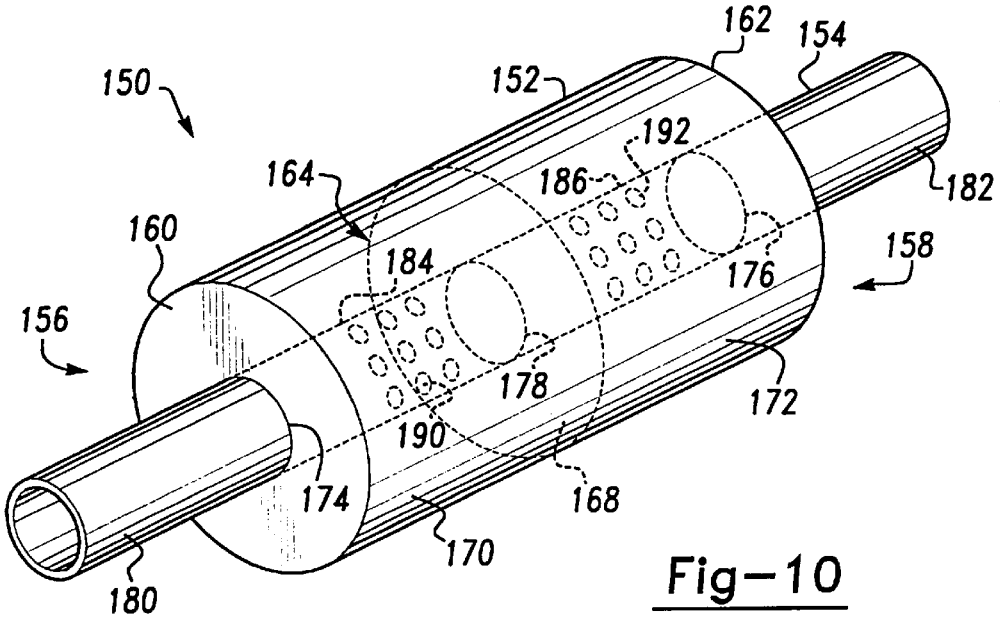
FIG. 10 is a perspective view of a two-chamber concentric tube perforated resonator according to a preferred embodiment of the present invention.

FIG. 10 is a partial cross-sectional view of a resonator 150 that is designed by the methodology described above. The resonator 150 is a two-chamber concentric tube perforated resonator for engine induction systems. Generally, the resonator 150 is formed from an outer tube, or tube, 152 and an inner pipe 154 extending co-axially through the outer tube 152. Each of these resonator components will be described in more detail below.

Figure 11:
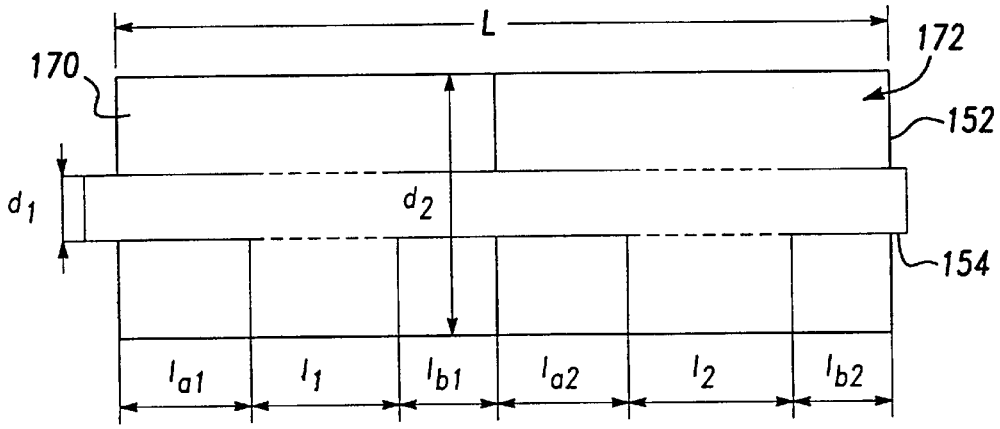
FIG. 11 is a side elevational view of the resonator of FIG. 10 showing the dimensions thereof.
Figure 12:
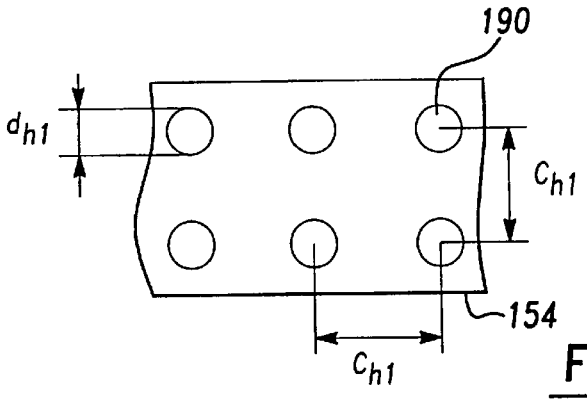
FIG. 12 is an enlarged view of a section of the resonator shown in FIG. 11.

Referring to FIGS. 10–12, the outer tube 152 is preferably a section of pipe formed from polypropylene and having a predetermined length L and an inner dimension d2. The tube includes first and second ends 156, 158, each having an associated end closure 160, 162. The end closures 160, 162 enclose the tube and define an interior volume 164 therebetween. A radially extending resonant chamber wall 168, preferably formed from polypropylene, is positioned within the interior volume 164 separates the interior volume into two resonant chambers 170, 172, each being isolated from the other. The end closures 160, 162 and the resonant chamber wall 168 define apertures 174, 176, 178, respectively, through which the second pipe 154 axially extends.

The inner pipe 154, which is preferably formed from polypropylene, has a diameter $d_1$ and extends axially through the center of the outer tube 152 and includes first and second outer segments 180, 182 and first and second inner segments 184, 186. First and inner outer segments 180, 182 extend outwardly from the tube 152, and are used to couple the resonator to additional induction system components as is well known in the art. The inner segments 184, 186 are each located in one of the defined resonant chambers 170, 172. Each of the inner segments 184, 186 includes a plurality of perforated holes, as shown at 190, 192.

As shown in FIG. 11, the plurality of holes in the first resonant chamber 170 is formed over a length $l_1$ of the inner segment 184 between unperforated lengths $l_{a1}$ and $l_{b1}$. Likewise, the plurality of holes 192 is formed in the resonant chamber 172 along a length $l_2$ between unperforated lengths $l_{a2}$ and $l_{b2}$.

FIG. 12 is a magnified portion of the perforated pipe length $l_1$ that shows the structure and spacing of the plurality of holes 190 therein. As shown, each of the plurality of holes 190 is preferably of a uniform diameter $d_{h1}$. For example, the diameter for a plurality of holes in a two-chamber concentric tube perforated resonator such as that shown at 150 may be 6.5 mm. However, this diameter may vary according to the other induction system components used and the type of engine with which the system is implemented. In addition, the holes are preferably evenly spaced apart from one another by distance $C_{h1}$. From the above example, the space between holes $C_{h1}$ may be 20.0 mm. However, it should be appreciated that the hole spacing may vary according to the particular application.

Figure 13:
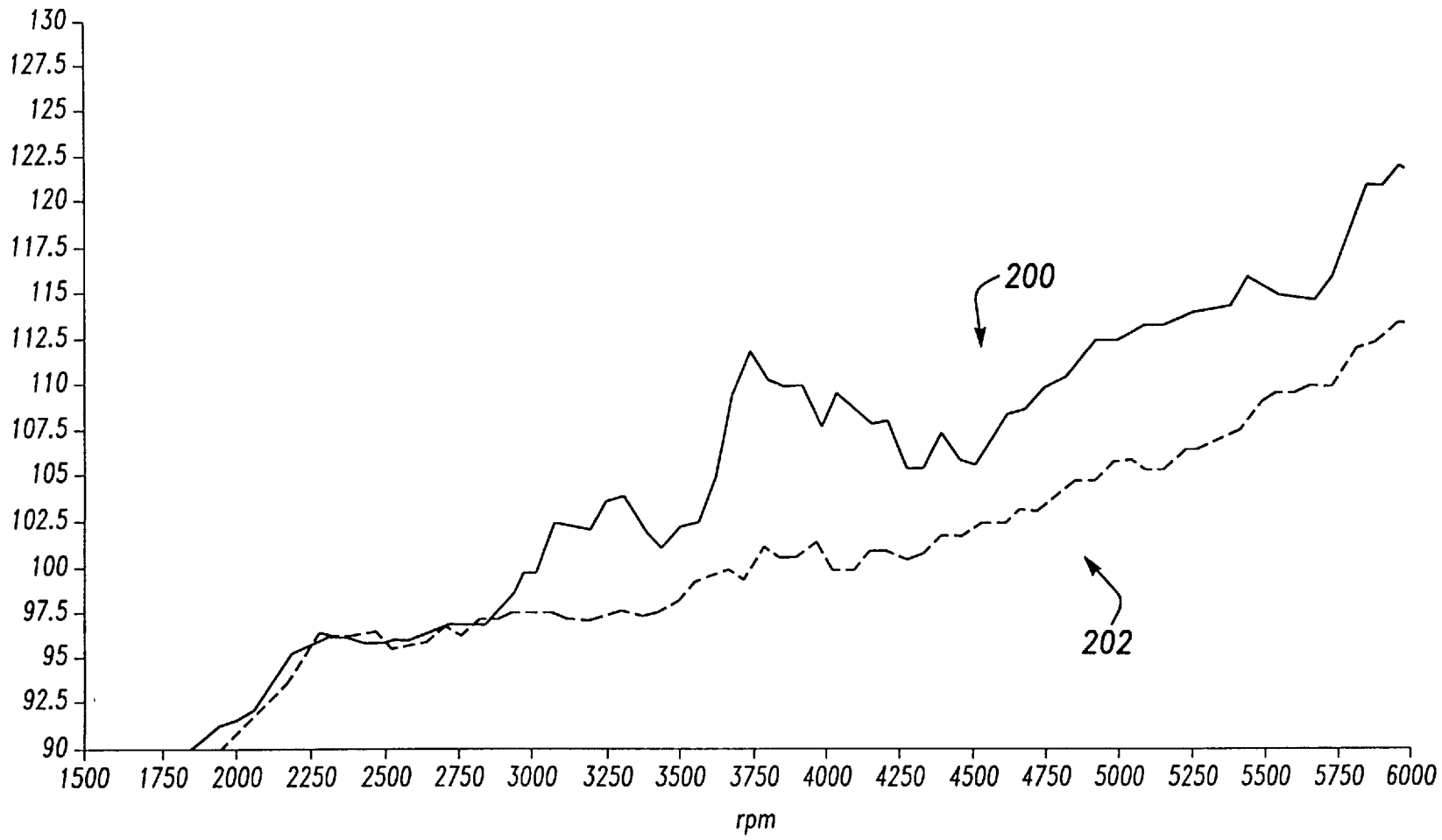
FIG. 13 graphically illustrates total sound pressure level versus rpm for the resonator shown in FIG. 11 and for a current production resonator.
Figure 14:
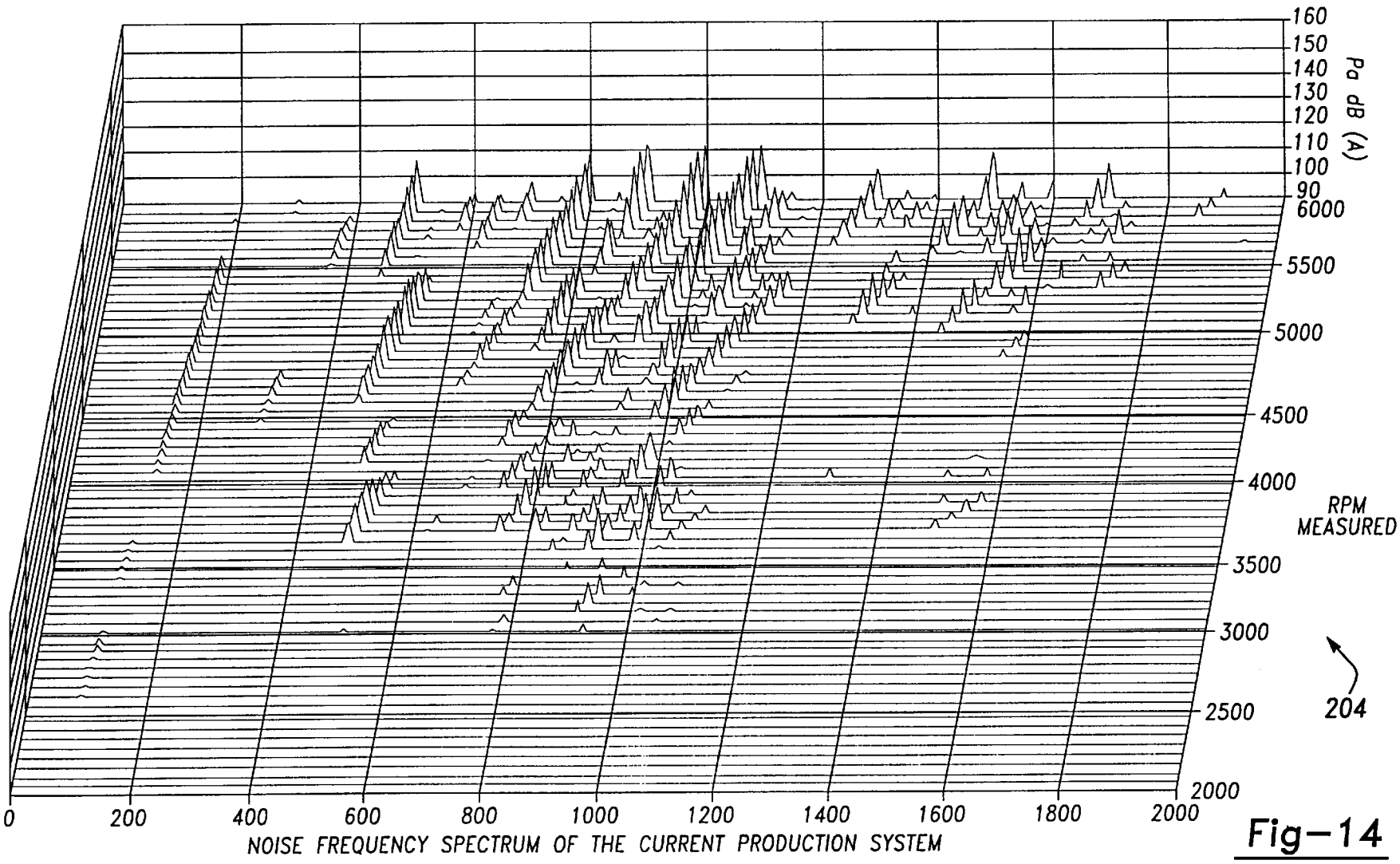
FIG. 14 illustrates the noise frequency spectrum of a current production induction system.
Figure 15:
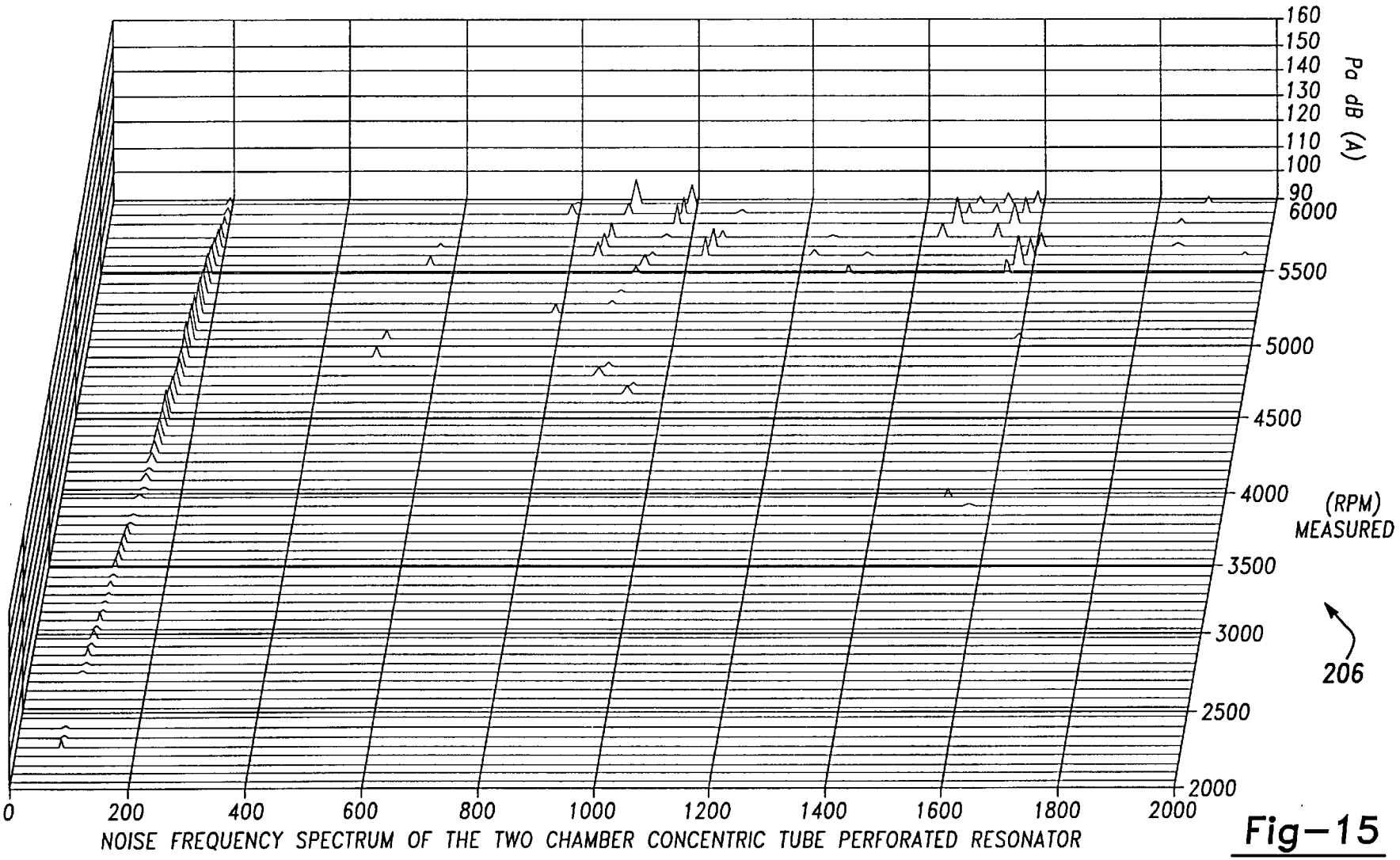
FIG. 15 graphically illustrates the noise frequency spectrum of an induction system utilizing the resonator of FIG. 10.

FIGS. 13–15 illustrate data generated from tests of a prototype two-chamber concentric tube perforated resonator such as the one shown at 150 in FIG. 10, implemented in a Chrysler 2.4 liter engine induction system, and having the dimensions set forth below in Table 1.

TABLE 1

| Resonator Component Dimension | Size |
|---|---|
| L | 290 mm |
| $d_1$ | 65 mm |
| $d_2$ | 200 mm |
| $I_{a1}$ | 4.9 mm |
| $I_{b1}$ | 34.9 mm |
| $I_1$ | 40.3 mm |
| $I_{a2}$ | 18.3 mm |
| $I_{b1}$ | 89.9 mm |
| $I_2$ | 101.6 mm |
| $d_{h1}$ | 6.0 mm |
| $c_{h1}$ | 17 mm |
| $d_{h2}$ | 6.0 mm |
| $c_{h2}$ | 20.3 mm |

The data in FIGS. 13–15 was generated by driving a motor vehicle engine with a dynamometer. No fuel or spark was provided, thus limiting the generated noise to the induction noise only. In particular, FIG. 13 graphically illustrates total SPL in db(A) versus engine speed in RPM for intake air muffled by (a) current production resonator at 200, such as Chrysler Part No. 4861055 manufactured by Siemens Automotive, and (b) the resonator of the present invention at 202.

As can be seen, SPL is significantly reduced by the resonator of the present invention when compared to SPL reduction of a typical current production resonator.

FIG. 14 graphically illustrates the noise frequency spectrum in hertz versus measured engine speed in RPM for a current production induction system generally at 204. FIG. 15 shows the same graphical plot as FIG. 14 at 206 for an induction system having a two chamber resonator of the present invention. Data for the graphs in FIGS. 13–15 was generated by recording noise emitted from an induction system intake port through a microphone positioned approximately six inches from the intake port. As can be seen, the resonator of the present invention significantly reduces the decibel level associated with engine noise emitted through the induction system across a low frequency spectrum range between 0 and 2000 hertz from 0–6000 rpm.

Figure 16:
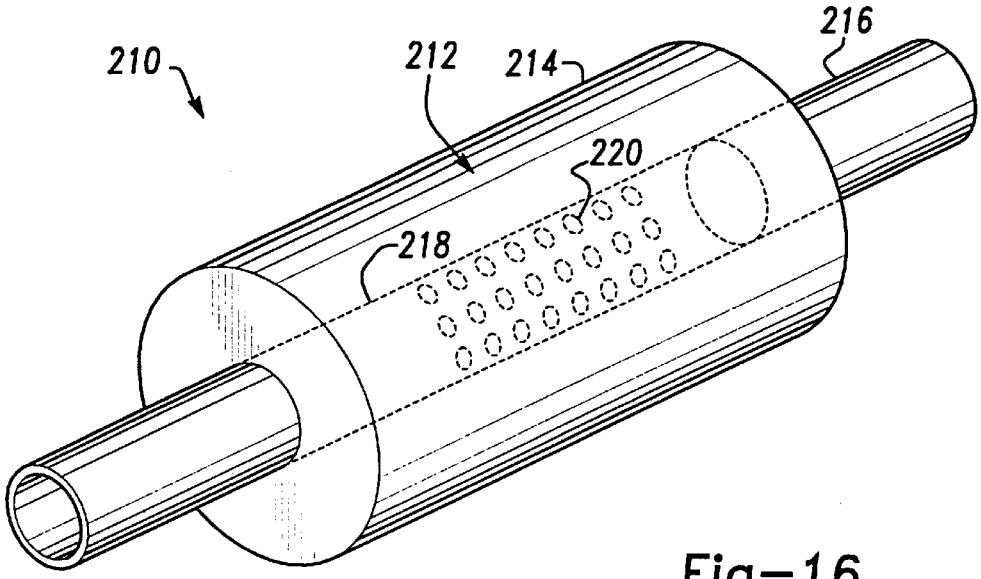
FIG. 16 is a perspective view of a single chamber concentric tube perforated resonator according to another preferred embodiment of the present invention.
Figure 17:
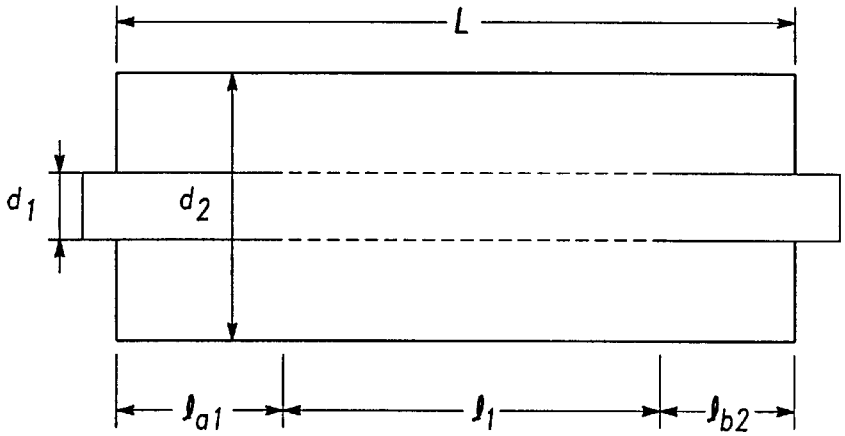
FIG. 17 is a side elevational view of the resonator of FIG. 16 showing the dimensions thereof.
Figure 18:
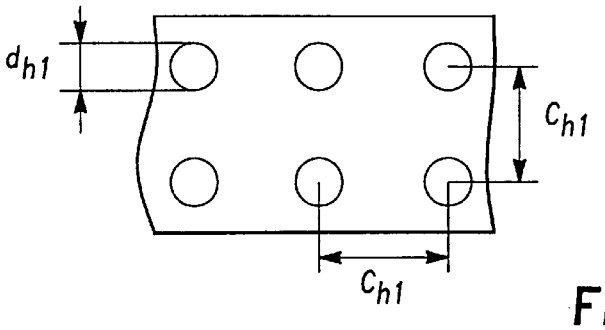
FIG. 18 is an enlarged view of a section of the resonator shown in FIG. 17.

FIG. 16 illustrates a second preferred embodiment of the concentric tube perforated resonator of the present invention generally at 210. The resonator 210 is similar in structure and function to the resonator 150, but includes only one resonant chamber 212 defined by the outer tube 214. In addition, the inner pipe 216 includes only one interior length 218 that defines a plurality of perforated holes, such as the hole 220. As with the resonator 150, the holes preferably are of equal diameter and are evenly spaced along the interior length 218. Sample resonator dimensions as in FIGS. 17 and 18 for the single chamber resonator implemented in a Chrysler 2.4 L engine induction system are shown in Table 2.

TABLE 2

| Resonator Component Dimension | Size |
|---|---|
| L | 290 |
| $d_1$ | 65 mm |
| $d_2$ | 300 mm |
| $I_{a1}$ | 30.0 mm |
| I | 45.0 mm |
| $I_{a2}$ | 215.0 mm |
| $d_{h1}$ | 7.0 mm |
| $c_{h1}$ | 2.5 mm |

Figure 19:
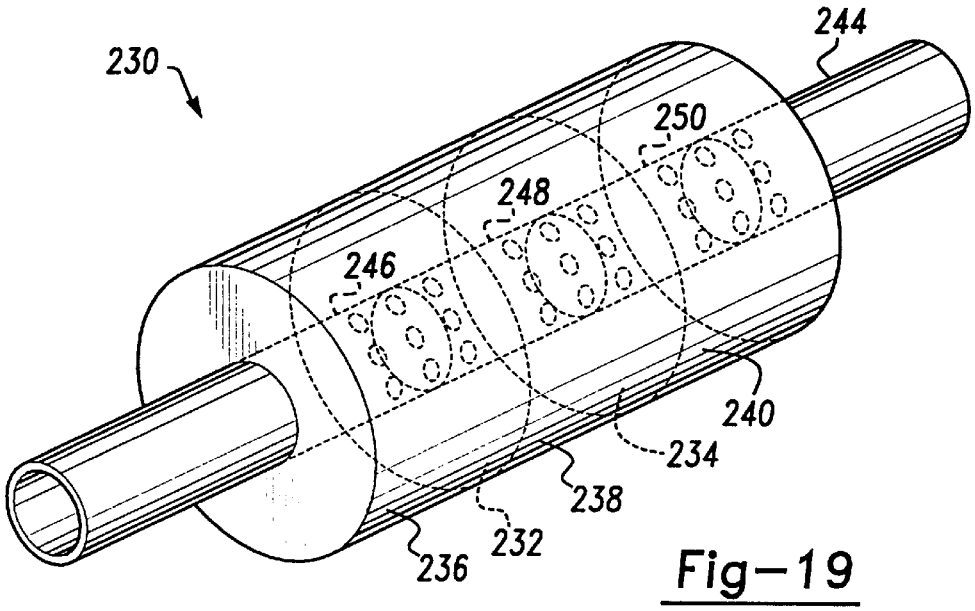
FIG. 19 is a perspective view of a three chamber concentric tube perforated resonator according to yet another preferred embodiment of the present invention.
Figure 20:
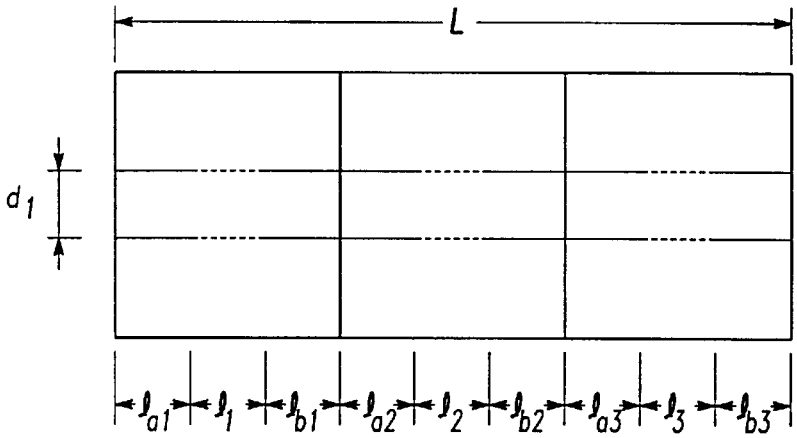
FIG. 20 is a side elevational view of the resonator of FIG. 19 showing the dimensions thereof.
Figure 21:
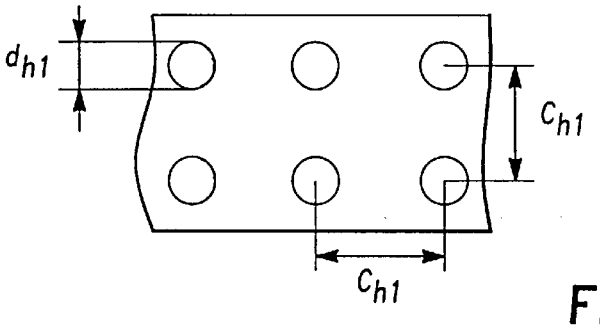
FIG. 21 is an enlarged view of the resonator shown in FIG. 20.

FIGS. 19–21 illustrate a third preferred embodiment of the present invention generally at 230. The resonator 230 is similar in structure and function to the resonators 150, 210. However, the resonator 230 includes two chamber walls 232, 234 that define three resonant chambers 236, 238, 240. The dimensions of the individual chambers, and the size, location, and number of holes in each chamber, may vary according to the particular environment in which the resonator is implemented and the particular frequencies desired to be suppressed. The inner pipe 244 thereby defines three inner lengths 246, 248, 250, each defining a plurality of perforated holes having dimensions and configurations similar to the plurality of holes 190, 220 described above. As shown, the resonator 230 may be designed with three resonant chambers to dampen engine noise emitted through the induction system across a wide frequency band. Sample dimensions for the three chamber resonator are given below in Table 3.

TABLE 3

| Resonator Component | Size |
|---|---|
| L | 290 mm |
| $d_1$ | 65 mm |
| $d_2$ | 350 mm |
| $I_{a1}$ | 3.0 mm |
| $I_{b1}$ | 20 mm |
| $I_1$ | 57 mm |
| $I_{a2}$ | 5 mm |
| $I_{b1}$ | 15 mm |
| $I_2$ | 100 mm |
| $I_{a3}$ | 10 mm |
| $I_{b3}$ | 20 mm |
| $I_3$ | 60 mm |
| $d_{h1}$ | 6.5 mm |
| $c_{h1}$ | 25.0 mm |
| $d_{n2}$ | 3.0 mm |
| $c_{h2}$ | 12 mm |
| $d_{h3}$ | 4.5 mm |
| $c_{h3}$ | 15.0 mm |

Upon reading the foregoing description, it should be appreciated that the modeling method of the present invention is designed so that no extensive training is required for engineers or designers to use the associated design software. The method of the present invention also allows a variety of different modeled induction system designs to be evaluated during the design process. Both of these features represent a significant improvement over conventional complex software modeling systems based on inherently subjective input parameters.

In addition, the method of the present invention is flexible enough to allow different optimization objective functions to be used, therefore allowing examination of variations in system designs. The method of the present invention also decreases system design time in that no trial and error iterations are necessary for changing system dimensions. The method of the present invention allows various volume and length specifications for chosen system components to be evaluated early in the design process, and allows under the hood space to be allocated for the best possible noise reduction for space available. The method of the present invention also improves sound quality through reductions in noise levels and introduction of system resonant harmonics.

While the above detailed description describes the preferred embodiment of the present invention, the invention is susceptible to modification, variation and alteration without deviating from the scope and fair meaning of the subjoined claims.

What is claimed is:

1. An engine induction system resonator, comprising:

a tube having a first diameter;

a first resonant chamber wall disposed in said tube, said resonant chamber wall and said tube together defining first and second resonant chambers;

a pipe having a second diameter smaller than said first diameter of said tube; said pipe extending axially through said tube, said pipe further having first and second ends connected to other induction system components, said pipe channeling inductive air flow therethrough; and a plurality of perforated holes disposed along a section of said pipe housed within said tube, said plurality of perforated holes being distributed along said pipe in a manner that minimizes emitted engine noise.

2. The resonator of claim 1, wherein said plurality of perforated holes is distributed along said pipe in a manner dependent upon the types and dimensions of other system components, system dimensional constraints, and specific engine acoustical parameters.

3. The resonator of claim 1, wherein said plurality of perforated holes are evenly spaced and are of equal diameter.

4. The resonator of claim 1, wherein said plurality of perforated holes is divided into first and second groups, said first group being located in said first resonant chamber, said second group being located in said second resonant chamber.

5. The resonator of claim 1, further comprising a second resonant chamber wall that divides an interior volume of said first pipe section into three resonant chambers.

6. The resonator of claim 4, further comprising a plurality of resonant chamber walls that divide an interior volume of said pipe into a plurality of resonant chambers.

7. A motor vehicle induction system resonator, comprising:

an enclosed tube defining a volume therein, said volume being divided into at least two resonant chambers by a radially extending chamber wall;

a pipe extending axially through said tube and resonant wall and that includes first and second ends for connection to additional system components, said pipe being perforated to define a plurality of evenly spaced holes in each resonant chamber that allow inducted air flowing through said pipe into each chamber for noise dampening purposes.

8. The resonator of claim 7, wherein said tube and said pipe are of a size and dimension dictated by additional system component sizes and dimensions, motor vehicle engine type, and implementation area constraints.

9. The resonator of claim 7, wherein said plurality of evenly spaced holes is formed to generate resonate engine harmonic frequencies.

10. A motor vehicle induction system that minimizes emitted engine noise, comprising:

a motor vehicle engine including a manifold and a throttle body;

a resonator coupled to the throttle body, said resonator comprising an enclosed tube defining a volume therein, and a pipe extending axially through said tube and defining a plurality of perforated holes that emit inducted air flowing therethrough into said interior volume for noise dampening purposes;

a first chamber wall dividing said volume of said tube into first and second resonant chambers;

an air cleaner coupled to said resonator that filters the inducted air; and an air inlet port in communication with said air cleaner that permits passage of ambient air into the induction system;

said resonator being designed in accordance with engine parameters, induction system component dimensions and types, and implementation area size constraints to minimize engine noise being emitted through said air inlet port.

11. The system of claim 10 wherein said plurality of perforated holes being divided into first and second groups, each of said groups being disposed within one of said first and second resonant chambers.

12. The system of claim 11, further comprising a third chamber wall that, in combination with said first and second chamber walls, divides the volume of said tube into first, second and third resonant chambers, the plurality of holes being divided into first, second and third groups with each of the groups being disposed within one of the first, second and third resonant chambers.

* * * * *